United States Patent [19]

Peters et al.

[11] Patent Number: 4,653,677

[45] Date of Patent: Mar. 31, 1987

[54] VESSEL HAVING A MOLTEN MATERIAL OUTLET

[75] Inventors: Bruce C. Peters, Midland, Mich.; M. Dale Mayes, Baton Rouge, La.; Richard M. Gross, Baton Rouge, La.; Stanley R. Pearson, Baton Rouge, La.

[73] Assignee: The Dow Chemical Company, Midland, Mich.

[21] Appl. No.: 723,769

[22] Filed: Apr. 16, 1985

[51] Int. Cl.[4] ..... B22D 41/00; F23J 1/08

[52] U.S. Cl. ..... 222/591; 266/45; 266/236; 48/DIG. 2; 110/165 R; 110/266

[58] Field of Search ..... 48/62 R, 63, 64, 76, 48/77, DIG. 2; 222/591; 110/165 R, 266; 266/45, 236, 269, 271, 287

[56] References Cited

U.S. PATENT DOCUMENTS 4,312,637 1/1982 Loftus ..... 48/77
4,427,184 1/1984 Steinwider et al. ..... 266/236

FOREIGN PATENT DOCUMENTS 557960 10/1923 France ..... 110/266
9887 1/1983 Japan ..... 222/591

*Primary Examiner*—David L. Lacey
*Attorney, Agent, or Firm*—Arthur J. Young

[57] ABSTRACT

A vessel having a floor which includes a tap outlet through which liquid contents in the vessel can be drained. The tap outlet features a shallow aperture circumscribed by first and second drip lines. The second drip line circumscribes the first drip line and is substantially coplanar with the first drip line. The two drip lines are connected one to the other by an annular hollow surface.

15 Claims, 2 Drawing Figures

VESSEL HAVING A MOLTEN MATERIAL OUTLET

BACKGROUND OF THE INVENTION

Figure 1:
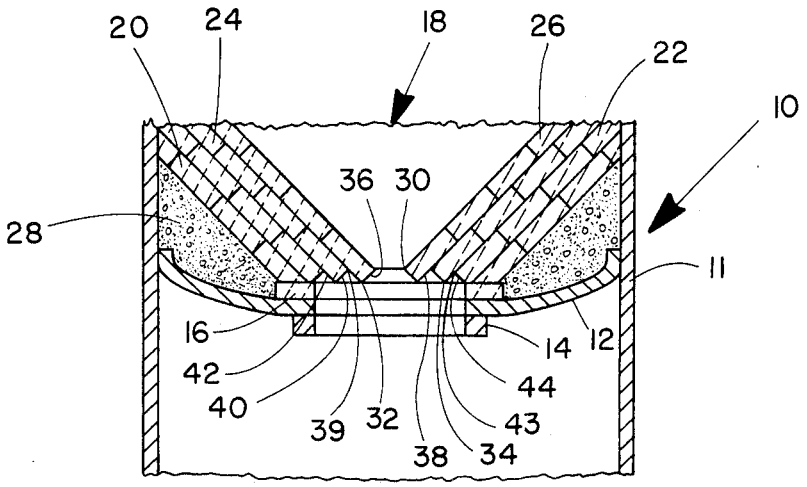

This invention relates to the gasification of finely divided solids, and more particularly, to coal gasification plants of the kind in which coal or other carbonaceous fuel is introduced into a gasifying vessel and is converted at high temperature and in the presence of oxygen, to synthesis gas and an ash by-product.

The ash by-product collects as molten slag at a low point in the gasifying vessel and must be continuously removed therefrom. Such removal is usually achieved by providing the gasifying vessel with a slag tap through which the molten material can pass. The gasification industry recognizes that the configuration of and the material of construction for the tap are determinative of tap life. Selection of the materials of construction must be made dependent upon the high temperature environment in which the tap will be used and the errosive and corrosive nature of molten slag. The tap configuration is important as it must provide for the flow of the molten slag through the tap without slag solidification around or within the tap to cause tap bridging and close-off. If the tap is configured to have a deep bore through which the molten slag must pass, then slag solidification will most likely occur as the slag within the bore is too far removed from the interior vessel temperatures and/or shielded from radiant heat coming from the vessel interior.

Various tap configurations have been suggested to reduce solidification. See, for example, U.S. Pat. No. 4,312,637.

It is an object of this invention to provide an outlet tap which resists close-off due to the solidification of molten material within the tap and/or adjacent its exterior mouth. It is a further object of this invention to provide a tap having a configuration which can be simply formed from conventional refractory materials.

THE INVENTION

This invention relates to a tap outlet located in a floor of a vessel through which the liquid contents of the vessel may be drained. The tap outlet is configured so as to reduce the liquid's passage time as it moves through the tap outlet. This particular feature is especially important when the liquid is molten as the chance of solidification of the molten liquid in the tap outlet or at its exterior mouth is greatly reduced. To reduce the liquid passage time, the tap outlet provides an aperture having minimal depth. For draining molten slag from a coal gasification vessel which is at a temperature from about 2400° F. to about 3000° F. the aperture would preferably have a depth less than about 4 inches to insure that there is no solidification therewithin. The aperture is preferably configured to be free of angular intersections within its bore as such intersections encourage liquid buildup at their locations. This buildup is best avoided as it can become so large that solidification of the liquid at the bottom of the buildup is facilitated. For this reason, curvilinear apertures are preferred, with circular apertures being most preferred.

Irrespective of aperture configuration, the least distance across the aperture should be sufficiently large to allow the liquid to move through the aperture quickly. Determination of the least distance is best made empirically keeping in mind that aperture configuration, slag flow rate, viscosity and surface tension are all influential factors to be considered. It has been found that, for a circular aperture to be used in draining molten slag from a commercial 2400° to 3000° F. coal gasification reactor, the aperture diameter should be at least 6 inches and preferably within the range from about 12 to about 48 inches.

Downwardly displaced and radially spaced outward from the aperture is a first drip line which circumscribes the aperture. Preferably the drip line is radially spaced outward from the aperture sO that the distances from any of the points on the drip line to their respective nearest points on the aperture are substantially equal. This relationship yields correspondence between the drip line configuration and the aperture bottom configuration with the former being dimensioned larger than the latter to effect the required circumscription. Under these preferred criteria, a circular aperture would be associated with a circular first drip line having a diameter larger than the diameter of the aperture.

The aperture is connected to the first drip line by way of a continuous surface. For example, when the aperture is circular, the continuous surface would be an annular surface and preferably a frusto-conical surface.

The tap outlet also provides a second drip line which circumscribes the first drip line. The second drip line is preferably configured similar to, even though larger than, the first drip line so that the various distances between the points on the second drip line and their respective nearest points on the first drip line will be equal. Therefore, if the first drip line is circular so will be the second drip line, but with a larger diameter.

The first and second drip lines will generally be found to be most useful if they are substantially coplanar. The degree to which the coplanar relationship can be achieved will be dependent upon the materials of construction and upon construction techniques. For example, if the tap outlet is circular and has a diameter of 24 inches and is made of refractory bricks then normally the relationship between the two drip lines may be 1 to 3 inches at variance with a true coplanar relationship.

The first and second drip lines are connected one to the other by a first hollow continuous surface. This hollow surface is usefully comprised of two frusto-conical surfaces which intersect one another in a plane above the first and second drip lines. The intersection occurs between the base of one of the surfaces and the apex of the other surface. The angle of intersection is preferably about 90° or obtuse, with an angle of about 90° being most preferred.

In practice, the liquid contents pass quickly through the aperture due to its minimal depth. Should there be any liquid drip from the aperture, it will follow the first surface to the first drip line. The edge configuration of the first drip line is such that it encourage the quick collection of the dripped liquid on it and so that the liquid will quickly obtain sufficient weight to overcome the adherence of the liquid to the drip line as a result of the liquid's surface tension. The quick collection on and release from the drip line minimizes the chance of solidification on or about the drip line due to molten liquid cool down. Should the amount of liquid dripping from the aperture overwhelm the first drip line, the second drip line is provided to achieve the same quick collection and release of the liquid as does the first drip line. Other drip lines circumscribing the two drip lines just described can be used for the tap outlet of the invention.

The necessity of additional drip lines will be dependent on the extent of liquid drip at the aperture and upon the fluid properties of the liquid passing through the tap outlet. Also, additional drip lines may be useful from the standpoint of providing in-situ spar drip lines in the event inner drip lines are lost. This in-situ provision is beneficial as the reaction occurring in the vessel does not need to be brought down to effect drip line replacement.

Quick liquid removal is also facilitated by locating the first drip line sufficiently close to the aperture so that the distance the dripped liquid has to travel from the aperture to the drip line is small. For example, if the tap outlet is for use in a coal gasification vessel and has a circular aperture having a diameter of about 24 inches, then the travel distance is optionally from about 2 to about 5 inches. The second drip line should not be too close to the first drip line so as to interfere with the drip from the first drip line but also not so far away as to delay the second dripping of the dripped liquid. Again, empirical determination of the location of the second drip line is necessary. For the just-described coal gasification reactor tap outlet, it has been found useful for the second drip line to have a diameter which is about 6 to about 12 inches greater than that of the first drip line.

Due to the novel configuration of the tap outlet of this invention, it is possible to make it from prefired brick as hereinafter described. The use of fire brick gives an important advantage over other configurations which, due to their geometrical requirements, demand that non-prefired refractory materials such as ram mix, castable refractory or plastic refractory be utilized. The use of prefired bricks is desirable as the bricks have a high density and a low porosity thereby giving them acceptable life for those applications where molten liquids such as molten slag are to be encountered. Also, the utilization of prefired bricks makes it most convenient to provide a circular aperture having so little depth that it may be referred to as a "knife edged" opening. Advantages of minimizing the depth of the tap outlet were previously discussed.

Figure 2:
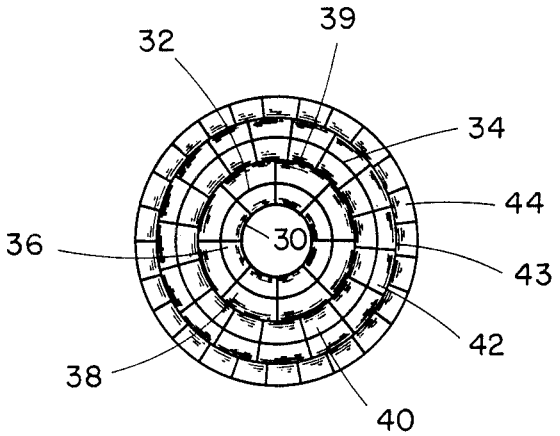

These and other features contributing to satisfaction in use and economy in manufacture will be more fully understood from the following description of a preferred embodiment of the invention when taken in connection with the accompanying drawings in which identical numerals refer to identical parts and in which:

FIG. 1 is a cross-sectional view of the lower portion of a vessel containing a tap outlet of this invention; and FIG. 2 is a bottom plane view of the tap outlet shown in FIG. 1.

Referring now to FIGS. 1 and 2, there can be seen a vessel, generally designated by the numeral 10, having located in its interior a tap outlet of this invention, generally designated by the numeral 18. Vessel 10 has an exterior wall 11 which, in most circumstances and for the embodiment shown in the drawings, is cylindrical in shape for at least that portion within which the tap outlet is located. This cylindrical shape is not required but rathe is preferred. Vessel 10 has a floor 12 having an opening at its center. This opening is circumscribed by flanges 14 and 16, the former being located on the bottom surface of floor 12 and the latter being located on the upper surface of the floor. These flanges ar conventionally found to be beneficial to rigidify floor 12 about its central opening and to aid in support of tap outlet 18.

Tap outlet 18 is comprised of four courses of prefired refractory brick, such as Zirchrome-60, manufactured by Lafarge Refractairies of France, which all define frustoconical surfaces. The base course 20 overlies insulating and support granular material 28. The apex of base course 20 is dimensioned so as to lie over and on flange 16. The angle which the frusto-conical surface of base course 20 makes with its vertical axis will be duplicated by the overlying other courses. To provide for fast and complete flow of the liquid held in the vessel through tap outlet 18, the surface to vertical axis angle, for most liquids, falls preferably within the range of from about 30° to about 60° Some liquids, however, due to their viscosity, may be best handled with surface to vertical axis angles either above or below the just stated range.

Overlying base course 20 is second course 22. The diameter of second course 22, at its apex, is smaller than the diameter of the apex of course 20. Note, as represented in the drawings, that the bricks which comprise second course 22 are staggered so that the joint lines of base course 20 and second course 22 do not overlie one another. This staggering of mortar joints is a well known technique used in the art of constructing furnace floors from brick and has been proven helpful in maintaining floor integrity during furnace operation. Staggering of the mortar joints is also used for third course 24 and fourth course 26. Third course 24 overlies second course 22 and has an apex diameter smaller than the apex diameter of second course 22. Fourth course 26 overlays third course 24 and has an apex diameter which is the smallest of the apex diameters.

As can be seen in FIG. 1, fourth course 26 provides at the inwardmost edge of its apex a circular aperture which is defined by the upper end edges of the bricks which define the apex of fourth course 26. These bricks, especially prefired brick, provide sharp edges and thus, circular aperture 30 is knife-edged. The bricks forming the apex of fourth course 26 also provide, with their lower end edges, circular drip line 32. Circular drip line 32 is also knife-edged due to the sharp-edged configuration of the brick. This knife-edged configuration is beneficial as it provides very little surface for adherence of the liquid to the drip line thereby requiring very little liquid accumulation to effect release of the liquid therefrom.

The end faces of the bricks located about the apex of fourth course 26 also provided frusto-conical surface 36 which joins together circular aperture 30 and first circular drip line 32. The distance between the circular aperture and circular drip line is the thickness of the brick. For most refractory bricks, this distance will be from about 2 to about 4 inches. As can be appreciated, this distance is quite small and is beneficial in ensuring quick delivery of any dripped liquid to first circular drip line 32 so that the liquid can be quickly disengaged from the tap outlet. Other distances may be useful, so long as the distance that the dripped liquid from circular aperture 30 has to travel does not yield a travel time which will be conducive to liquid cool-off to the point of solidification before it drips from any of the circular drip lines.

Second course 24 provides, by way of the bricks forming its apex, second circular drip line 34. Note that circular drip line 34 is substantially coplanar with first circular drip line 32. Second circular drip line 34 is configured similar to first circular drip line 32. The first and second circular drip lines are connected to one another by way of a first hollow annular surface which, for the embodiment shown, is comprised of frusto-conical surface 38 and a frusto-conical surface 40. Frustoconical surface 3 intersects, at its base, the apex of frusto-conical surface 40 at a approximate 90° angle. This point of intersection 39 is located above the plane in which circular drip lines 32 and 34 lie. By providing this above-the-plane location for intersection 39, two functions are accomplished--liquid movement in an outward radial direction is first discouraged as such movement requires an upward flow and, second, if such outward radial movement cannot be totally controlled, then, for the non-controlled liquid, the outward radial movement is encouraged due to the downward flow path provided. Thus, the non-controlled liquid is quickly brought to second circular drip line 34.

For the embodiment shown in the Figures, a second hollow annular surface is provided. The second hollow surface operates in the same manner and for the same reasons as the just-described first hollow surface. The second annular hollow surface is comprised of frusto-conical surfaces 42 and 44. The base of surface 42 intersects the apex of surface 44 to form intersection 43 which is above the plane(s) in which the first and second circular drip lines lie. Any liquid which contacts frusto-conical surface 44 will be directed to flow onto the inner surfaces of flanges 14 and 16. If this liquid is originally molten, it may very well solidify on these surfaces as the surfaces do not have drip enhancing configurations. If the amount of solidification is unacceptable, i.e., outlet tap close-off occurs too often for the desired economic efficiency of the process involved, then another or a series of drip lines, similar to first and second drip lines 32 and 34 may be provided to facilitate quick drip of the liquid from outlet tap 18.

The base to apex dimensions (width) of the various frusto-conical surfaces which make up the annular hollow surfaces are those which insure quick liquid movement to the circular drip lines without being promotive of liquid bridging between the drip lines. Determination of the best widths for any particular application is dependent on many factors, e.g., the liquid's solidification temperature and its fluid properties, the rate of liquid cool-off, the drip line configuration, etc., and thus, is best made empirically. When refractory bricks are utilized to produce tap outlet 18, it is most convenient, for those frusto-conical surfaces formed by the brick end surfaces, e.g., surfaces 36, 40 and 44, to have their widths commensurate with the width dimensions of the brick surfaces ends. Those frusto-conical surfaces formed by a portion of the under surface of the bricks, e.g., surfaces 38 and 42, will have widths dependent upon the angle the frusto-conical surfaces make with their vertical axis. For example, if the surface to vertical axis is 45° and the angle at intersections 39 and 43 is 90°, then the widths of the two frusto-conical surfaces forming each hollow annular surface will be equal and thus determined by the width dimension of surface edges 36, 40 and 44.

The preferred angle at intersections 39 and 43 is substantially a right angle as such angle is believed to result in maximized liquid flow without attenduant liquid bridging between the two surfaces forming the annular hollow surface.

Although the foregoing illustrates a single embodiment of this invention, this invention is not to be limited thereby. Modification and variation may be made to the disclosed embodiment without departing from what is regarded to be the subject matter of this invention. For example, it is within the scope of this invention to provide that the tap outlet have the geometric configuration of the embodiment of FIGS. 1 and 2, but that the tap outlet be formed of materials other than refractory brick, e.g., castable refractory material. Further modification of the configuration of the component parts of the illustrated outlet is contemplated herein. For example, the hollow annular surfaces may be configured so as to provide a semicircular or parabolic profile, when viewed in vertical-section, rather than the angular profile provided by the before-described frusto-conical surfaces.

We claim:

1. A vessel having a floor which includes a tap outlet through which liquid contents to be contained in said vessel may be drained, said tap outlet comprising:
   (a) a first course of bricks positioned and arranged so as to define an aperture, a first drip line which is below and which circumscribes said aperture and a continuous surface connecting said first drip line with said aperture; and
   (b) a second course of bracks positioned and arranged so as to define second drip line which circumscribes said first drip line, said second drip line,
      (i) being substantially coplanar with said first drip line, and
      (ii) being connected to said first drip line by a first continuous hollow connecting surface defined by portions of said first and second courses of brick.

2. The vessel of claim 1 wherein said aperture is curvilinear.

3. The vessel of claim 2 wherein said curvilinear aperture is a substantially circular aperture.

4. The vessel of claim 3 wherein said first drip line is substantially circular.

5. The vessel of claim 4 wherein said continuous surface is a first frusto-conical surface connected at its apex to said substantially circular aperture and at its base to said substantially circular first drip line.

6. The vessel of claim 5 wherein said substantially circular aperture has a depth of less than about 4 inches.

7. The vessel of claim 1 wherein said first and second drip lines are substantially circular and said first continuous hollow connecting surface comprises second frusto-conical surface defined by said first course of bricks and a third frusto-conical surface defined by said second course of bricks, said second frusto-conical surface being connected at its apex to said first drip line and at its base to the apex of said third frusto-conical surface, the connection of said second and third frusto-conical surfaces being at a point above said first and second drip lines, and said third frusto-conical surface being connected at its base to said second drip line.

8. The vessel of claim 7 wherein said connection of said second and third frusto-conical surfaces is substantially a right angle shaped connection.

9. The vessel of claim 8 wherein said aperture is circular and has a depth less than about 4 inches.

10. The vessel of claim 7 wherein said top outlet further comprises a third course of bricks and said second drip line is bounded by said first continuous hollow connecting surface and by a second continuous hollow connecting surface, said second hollow connecting surface being defined by portions of said second course of bricks and said third course of bricks.

11. The vessel of claim 10 wherein said second continuous hollow connecting surface comprises a fourth frusto-conical surface defined by said second course of bricks and a fifth frusto-conical surface defined by said third course of bricks, said fourth frusto-conical surface being connected at its apex to said second drip line and at its base to the apex of said fifth frusto-conical surface, the connection of said fourth and fifth frusto-conical surfaces being at a point above said second grip line.

12. The vessel of claim 11 wherein said connection of said fourth and fifth frusto-conical surfaces is substantially a right angle shaped connection.

13. The vessel of claim 12 wherein said aperture is curvilinear.

14. The vessel of claim 12 wherein said aperture is substantially circular and has a depth of about 4 inches.

15. The vessel of claim 1 wherein said top outlet further comprises a third course of bricks and said second drip line is bounded by said first continuous hollow connecting surface and by a second continuous hollow connecting surface, said second continuous hollow connecting surface being defined by portions of said second course of bricks and said third course of bricks.

* * * * *